US007566275B2

(12) United States Patent
Yun

(10) Patent No.: US 7,566,275 B2
(45) Date of Patent: Jul. 28, 2009

(54) GOLF PUTTING TRAINING APPARATUS

(75) Inventor: Tae-Hyok Yun, Seoul (KR)

(73) Assignee: Sun Chul Yun, Seoul (KR)

( * ) Notice: Subject to any disclaimer, the term of this patent is extended or adjusted under 35 U.S.C. 154(b) by 0 days.

(21) Appl. No.: 11/820,050

(22) Filed: Jun. 18, 2007

(65) Prior Publication Data

US 2008/0009359 A1 Jan. 10, 2008

(30) Foreign Application Priority Data

Jun. 19, 2006 (KR) ..... 10-2006-0054685

(51) Int. Cl.
*A63B 69/36* (2006.01)

(52) U.S. Cl. ..... 473/152

(58) Field of Classification Search ..... 473/151–155, 473/190, 192, 198, 199, 219–222, 225, 278; 99/151–155, 190, 192, 198, 199, 219–222, 99/225, 278

See application file for complete search history.

(56) References Cited

U.S. PATENT DOCUMENTS 4,652,121 A * 3/1987 Ito et al. ..... 356/28
4,872,687 A * 10/1989 Dooley ..... 473/152
5,067,718 A * 11/1991 Knox et al. ..... 473/152
5,171,012 A * 12/1992 Dooley ..... 463/2
5,342,053 A 8/1994 Smith
5,437,457 A * 8/1995 Curchod ..... 473/199
5,481,355 A * 1/1996 Iijima et al. ..... 356/28
5,846,139 A * 12/1998 Bair et al. ..... 473/156
5,860,648 A * 1/1999 Petermeier et al. ..... 273/108.2
6,302,802 B1 * 10/2001 Pao ..... 473/156
7,335,116 B2 * 2/2008 Petrov ..... 473/407
2003/0166420 A1 * 9/2003 Chou ..... 473/151
2003/0203762 A1 * 10/2003 Ross ..... 473/151

FOREIGN PATENT DOCUMENTS

KR 20-0220556 4/2001
KR 20-0227508 6/2001

* cited by examiner

*Primary Examiner*—Mark S Graham
(74) *Attorney, Agent, or Firm*—J. Bennett Mullinax, LLC

(57) ABSTRACT

The present invention relates to a golf putting training apparatus comprising a reaction panel (2); a personal computer that computes detected data; a body having a display portion (3) that displays the output data; two triangular detection areas (A, B) that symmetrically crisscross each other in a plane space between the two side panels (4, 4') of the body (1); light emitting elements (L, R) of detection sensors (S1, S2) installed at the vertex positions of said triangular detection areas (A, B) on side panels (4, 4'); light receiving elements (L1, L2, R1, R2) of detection sensors (S1, S1) provided at the corner positions of the bottom lines of said triangular detection areas (A, B) in such a way as to face said light emitting elements (L, R).

20 Claims, 2 Drawing Sheets

GOLF PUTTING TRAINING APPARATUS

RELATED APPLICATION

This application claims the benefit of Korean Patent Application No. 10-2006-0054685 filed on Jun. 19, 2006 and registered as Patent No. 10-0671751 on Jan. 15, 2007 and whose contents are incorporated by reference herein in their entirety for all purposes.

NUMERALS FOR KEY PORTIONS OF THE DRAWINGS

Figure 1:
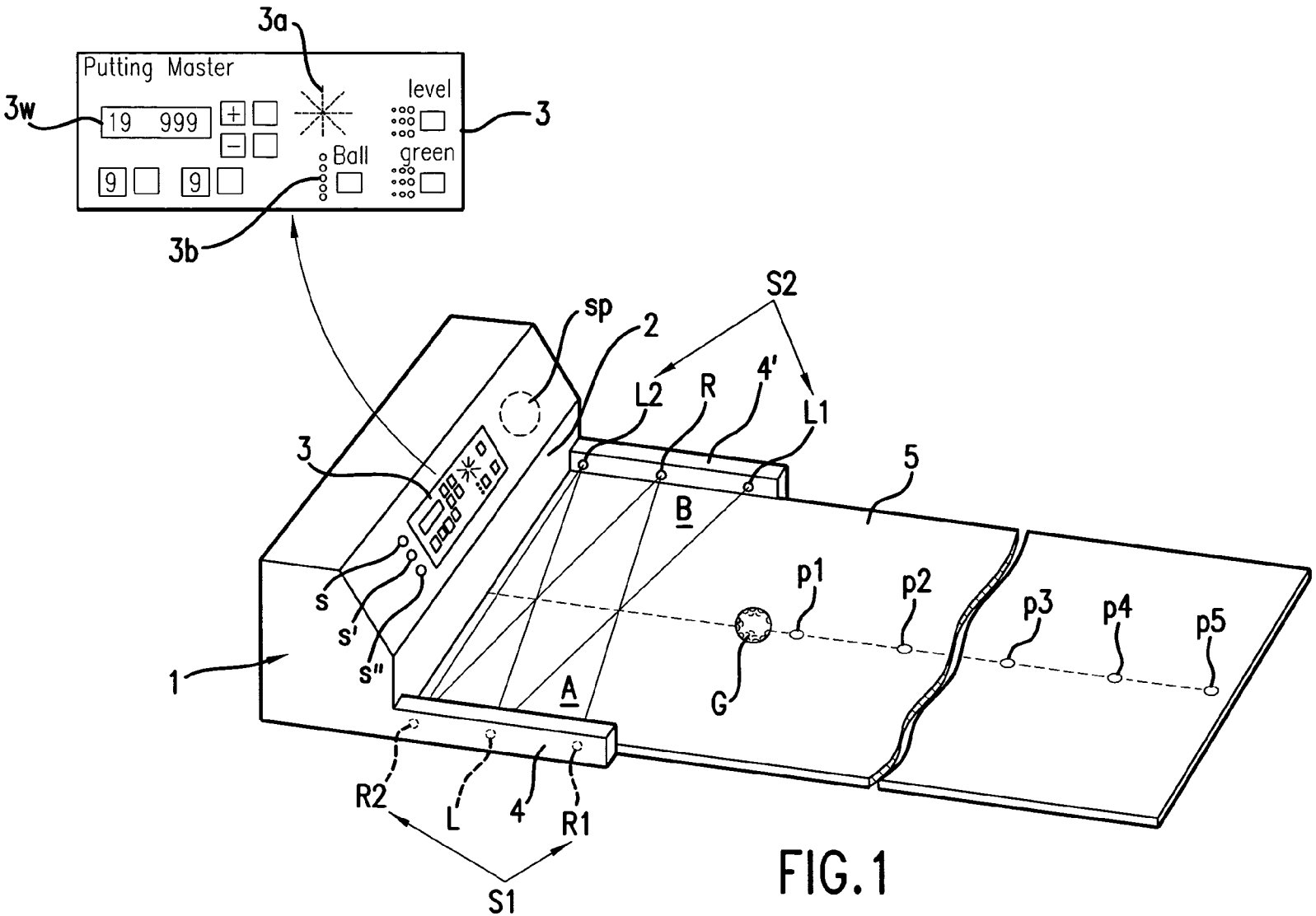
FIG. 1 is a perspective view of an embodiment of the present invention.

1: body; 2: reaction panel; 3: Display portion; 4, 4': side panel; 5: putting mat; A, B: triangular detection area; S1, S2: detection sensor; L, R: light emitting element; L1, L2, R1, R2: light receiving element; T1, T2, T3, T4: detection line

DETAILED EXPLANATION OF THE INVENTION

Objective of the Invention

TECHNICAL FIELDS AND PRIOR ARTS

The present invention relates to a putting training apparatus provided with means to detect the passage and movement of a putted golf ball having two triangular detection areas crisscrossing each other symmetrically in a plane space where the putted golf ball passes, wherein two detection sensors perform binary geometric detection of the passage of a golf ball when it passes said detection areas, and wherein the personal computer compares and computes the data values produced by the detection sensors so that the user of the apparatus may grasp the distance and various movements of the putted golf ball precisely and in detail.

Different from a golf ball hitting practice machine in which a golfer swings a golf club and hits a ball hard for a long distance target, a golf putting training apparatus is designed to improve putting skills by adjusting the strength and direction of the golf ball in putting to hole the putt from a short distance from the hole cup.

A putting training apparatus is provided with various detection means to detect the state of the training or the practice underway. Among the detection means are a vibration sensor, an acoustic sensor, a light sensor, an electronic sensor, a magnetic sensor, etc. that are used for various purposes. These detection sensors are combined in various forms in a complex structure in most cases.

An example of a conventional putting training apparatus that may be cited as a prior art of the present invention is U.S. Pat. No. 5,342,053 (registered 30 Aug. 1994), in which many detection sensors are provided on an arch-shaped support structure installed in a plane space in which the golf ball passes, a large number of said detection sensors being arranged on the support structure at short intervals horizontally to cover, detect and display the movement of the golf ball as the putted ball moves to the central, left or right portion of the target.

However, as the detection means in conventional golf putting training or practicing machines require so many detection sensors to detect the ball movements by movement angles, the construction of the detection apparatus becomes complex and requires high production cost. Moreover, the ball passing blind areas between the detection sensors cannot be detected, reducing the reliability of the detected data.

The detection means in the golf putting training apparatus in the prior art Korean Utility Model No. 20-0220556 (published 16 Apr. 2001) is a pair of detection sensors provided at a certain interval on each of the guide panels left and right between which there is a narrow straight alley where the putted ball passes, wherein the speed of the ball passing between the two detection sensors is detected to show the distance of the putted ball.

However, the detection means in the above putting training apparatus cannot detect various movement directions of the ball, a factor essential to putting training.

Another prior art that may be cited is the Korean Utility Model No. 20-0227508, in which a number of detection sensors are arranged by installing a large number of pairs of light emitting element and light receiving element in a parallel manner at regular intervals on the side panels on both sides of an alley in which the ball passes. The detection sensors detect the speed of the putted ball at each stage to display the putted distance and the movement of the ball.

However, despite the many detection sensors, the detection means in the above golf putting training apparatus cannot detect the movement directions (movement angles) of the ball that goes wide of the mark, which function is essential to a putting training apparatus.

As mentioned above, the detection means of most of the known conventional putting training apparatuses consist of a system wherein the moving speed of the putted ball and the direction of the putted ball are detected separately by separate detection sensors. Therefore, such a system requires a large number of detection sensors that detect the varying movements of the ball by movement angles, making the construction of the detection device complex, resulting in high production cost of the putting training apparatus, frequent troubles of the apparatus going out of order, and inconvenience in use.

TECHNICAL PROBLEM

The objective of the present invention is to provide a putting training apparatus equipped with a new detection means capable of detecting all the various movements of a putted golf ball simultaneously using simple and concise detection means.

Another objective of the present invention is to provide a putting training apparatus having two symmetrically crisscrossing triangular detection areas, which is different from the conventional apparatus having linear detection areas, producing two different data values containing triangular geometric elements detected from the movements of a putted ball passing the triangular detection areas, and comparing and computing the two sets of data values to display the distances and various directions of the putted ball precisely and in detail.

Another object of the present invention is to provide a putting training apparatus having a body provided with reaction panel, a personal computer that compares and computes the detected data values, and a display portion that displays the output data values electronically, as well as two side panels on the left and right of the body, each of the side panels being provided with a detection sensor having a light emitting element and two light receiving elements that detect the two symmetrically criss-crossing triangular detection areas, thereby the detection conditions are maintained consistently, enhancing the reliability of the detected data values, making it possible to obtain composite putting results with a simple and concise detection device.

The putting training apparatus in the present invention comprises a body having a reaction panel that reflexes the putted ball, a personal computer that computes the detected data values, and a display portion that displays the output data; two symmetrically criss-crossing triangular detection areas provided in the plane space between the two side panels on the left and right of the body; a light emitting element of the detection sensor arranged at the position of the vertex in each of said triangular detection areas; and two light receiving elements arranged at the bottom corner positions of each of the two criss-crossing triangular detection areas.

In the present invention, the reaction panel of the body is slightly declined inward to prevent the ball from bouncing out from the apparatus of the present invention and to keep the ball in the plane space inside. The computer, which is an ordinary personal computer, is equipped with a program necessary for computing the detected data values, the display unit of the display portion is capable of showing various forms of display, a drawing displays an example of an embodiment, and the results of the computing the detected data values are simultaneously displayed showing the putted distance and the movement direction of the ball in words or radiating electrooptic display. At the same time, the result of the computation of the detected data values is announced acoustically on a speaker as well.

The most important feature in the present invention is the detection means that detects the movements of the putted ball. Different from the conventional simple linear detection, the two triangular symmetrically criss-crossing detection areas in the present invention are provided in the plane space between the two side panels of the body, the height of the triangle is the distance between the bottom line of the triangle and the side panel on the other side, and each of the two triangular vertexes are positioned in the central portion of the side panels. Each of the two detection sensors on each side panel has one light emitting element and two light receiving elements, the light emitting element is arranged at the side panel in the vertex position of the triangle of the triangular detection area, the two light receiving elements that receive the light from the light emitting element are arranged at the corners of the bottom line of the triangle. Therefore, the light emitting element and the light receiving elements in each of the two detection sensors on the right and the left side panel are arranged in such a way as to face each other. It is desirable that the light emitting element and the light receiving elements in each detection sensor are installed by means of an appropriate attaching means on the side panels in such a way that they are maintained at the height of a radius of a golf ball. The light projection angle of each light emitting element should be wide enough for the two light receiving elements, which are located at the corners of the bottom line of the triangle on the other side, to receive the light, while covering at least the triangular detection areas. At this time, if the light projection angle of the light emitting element is limited, the interval between the two light receiving elements should be arranged to suit the limited light projection angle. On the putting mat for the putting training apparatus in the present invention, set positions of the golf ball to be putted are shown along the virtual central line at regular intervals.

The putting training apparatus in the present invention is characteristic in that its detection device is simple and its detection function is excellent. If the user putts the ball from a set position on the putting mat along the virtual central line toward the reaction panel, the putted ball advances and hits the reaction panel and bounces back.

Before the ball hits the reaction panel, the ball passes the criss-crossing triangular detection areas. At this time, the detection sensors installed on both side panels left and right of the body detects the time at which the ball passes the detection lines matching the two light beams of the triangle connected between the one light emitting element and the two light receiving elements. The data thus detected by the detection sensors on both sides are numerical data of the times at which the ball passes between the detection lines, i.e. the two light beams in each of the triangular detection areas, but the data thus made available are two sets of data values containing triangular geometric elements obtained from the features of the two criss-crossing triangular detection areas, which data values are compared and computed to arrive at the putted distances and the various moving directions, or angles, of the putted ball in detail. This is possible because the detection area does not consist in a line but it is made up of two criss-crossing triangular detection areas making it possible to obtain two sets of data values containing geometric elements.

It is easy to calculate the moving distance of the ball from its moving speed. However, in the present invention, two detection sensors produce two sets of data values of the moving distance in comparison with the speed of the ball passing in a straight line direction through the criss-crossing triangular detection areas. The speeds of the ball detected by the two detection sensors are theoretically identical. However, taking the error rate into account, the average values of the two sets of data arrived at by the two detection sensors can produce a more accurate and reliable distance of the putted ball.

The computation of the data are carried out by the central computing circuit of the personal computer provided in the body. The putted distance value is displayed electronically on the electrooptic display window in the display portion and announced acoustically on a speaker as well.

In the present invention, the user may putt the ball from a set position of the putting mat along the virtual central line toward the reaction panel, but the user may also putt the ball off the central line to the left or right of the central line. The range of the direction, or the angle, of the movement of the ball can vary widely and minutely within the entire detection areas between the two side panels after the ball is putted from the position where the ball is placed. In the conventional arts, many detection sensors were used to detect the many varying angles, but in the present invention, only a pair of detection sensors are used to detect the speed of the ball. The detected data values contain geometric elements making it possible to compute the speed of the ball against various detailed movement angles from the two sets of data values detected by the pair of detection sensors.

In other words, the movement direction of the putted ball is obtained from the relative comparative values of the data detected by the detection sensors on both side panels.

If the data detected by the two detection sensors on the side panels are compared and the two data values turn out identical, the display shows that the putted ball has moved along the virtual central line.

If the data detected by the two detection sensors on the side panels are compared and the data value of the left side detection sensor is larger than that of the right side detection sensor, the ball has moved toward the left of the central line, and the display shows accordingly. If the data value of the right side detection sensor is larger than that of the left side detection sensor, the ball has moved toward the right of the central line, and the display shows accordingly.

The degree of the difference in the data values between the left and the right side detection sensors represents in detail the degree of varying direction (or angle) of the movement of the ball putted in the plane space between the two side panels of the body.

The detection means in the putting training apparatus in the present invention is characteristic in that only one pair of detection sensors detect the movements of the golf ball as the ball passes through the triangular detection areas, coming up with two sets of data values containing geometric elements, which are then compared and computed by a computer to show the distance and the direction of the putted ball in a composite, precise display.

The detection means in the putting training apparatus of the present invention has a simple construction, is capable of detecting the data in a composite manner. With its high reliability of the detected data values, the user can easily grasp the putted distance and the varying directions of the ball putted, which is essential to training one's putting skill, so that the user may practice putting efficiently.

CONSTRUCTION OF THE INVENTION

FIG. 1 is an illustrative view of the putting training apparatus of the present invention in one embodiment comprising:

a) a body (1) consisting of a reaction panel (2);

a personal computer that computes the detected data;

a display portion (3) that displays the result of the computation;

b) two crisscrossing triangular detection areas (A, B) provided in a plane space between the two side panels (4, 4') of the body (1);

c) light emitting elements (L, R) of the detection sensors (S1, S2) installed at the side panels (4, 4') in the vertex positions of said triangular detection areas (A, B);

d) light receiving elements (L1, L2) (R1, R2) of the detection sensors (S1, S2) installed facing the light emitting element at the bottom corner positions of the triangular detection areas (A, B);

e) detection lines (T1, T2) connecting the light emitting element (R) with light receiving elements (R1, R2); and detection lines (T3, T4) connecting the light emitting element (L) with the light receiving elements (L1, L2) for detection of the plane space of the triangular detection areas (A, B).

The reaction panel (2) of the body (1) is slightly declined inward for the ball to bounce properly onto the ground. In the body (1), a speaker (sp) and a personal computer (not shown in the drawings) are built in. The display portion (3) is provided with a word display window (3*w*), a radiating electrooptic display device (3*a*), a position display unit (3*b*), a power switch (s), a sound adjusting switch (s'), and a resetting switch (s"). Along with the body (1), there is a putting mat (5) marked with set positions (p1, p2, p3 . . . ) of the ball to be putted at regular intervals.

Figure 2:
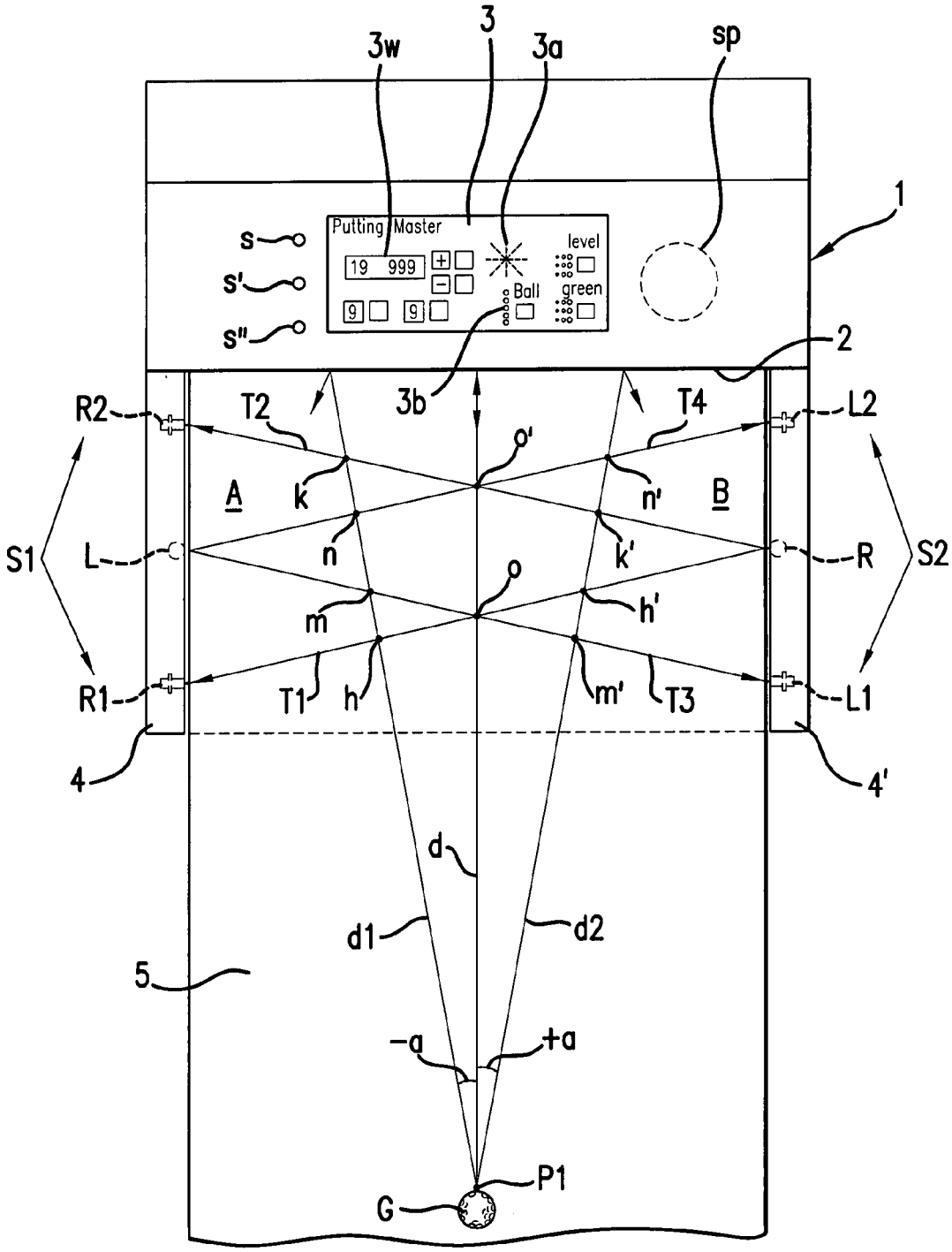
FIG. 2 is an expanded partial plane view illustrating the operation of the present invention.

In the present invention, the two triangular crisscrossing detection areas (A, B) provided in the plane space between the side panels (4, 4') of the body (1) are not on an earth ground but on a putting mat for the putted ball to move. As shown in FIG. 1 and FIG. 2, the distance between the two side panels (4, 4') of the body (1) equals the height of the triangle of the triangular detection areas (A, B), for the light emitting elements (R, L) are installed at the vertex positions of the triangles in the triangular detection areas and the light receiving elements (R1, R2, L1, L2) are installed at the corner positions of the bottom lines of the triangles of the triangular detection areas (A, B). The installation of the detection sensors (S1, S2) each having a light emitting element (L, R) and two light receiving elements (R1, R2, L1, L2) is not limited to the side panels. The detection sensors (S1, S2) may be installed on a separate installation stand.

A light emitting element (R) of the detection sensor (S1) is installed at the vertex position of the triangle of the triangular detection area (A) in the central portion of the side panel (4') on the other side, and two light receiving elements (R1, R2) are installed near the end portions of the side panel (4) at the bottom corners of the triangle of the triangular detection area (A), facing the light emitting element (R) on the other side.

And a light emitting element (L) of the detection sensor (S2) is installed at the vertex position of the triangle of the triangular detection area (B) in the central portion of the side panel (4) on the other side, and two light receiving elements (L1, L2) are installed near the end portions of the side panel (4') at the bottom corners of the triangle of the triangular detection area (B), facing the light emitting element (L) on the other side.

The light projection angle of the light emitting elements (L, R) is wide enough for the light receiving elements (L1, L2, R1, R2) to receive the light emitted.

As shown in FIG. 2, the detection sensor (S1) on the left side in the drawing detects the triangular detection area (A) set by the detection lines (T1, T2) (the emitted light) connected between the one light emitting element (R) on the other side and the two light receiving elements (R1, R2) on its side, and the detection sensor (S2) on the right side in the drawing detects the triangular detection area (B) set by the detection lines (T3, T4) (the emitted light) connected between the one light emitting element (L) on the other side and the two light receiving elements (L1, L2) on its side.

The operation of the putting training apparatus in the present invention having the aforesaid construction is as follows.

As shown in FIG. 2, if the power switch (s) is turned on, power is supplied to the personal computer and all the other electronic devices, and a pair of detection sensors (S1, S2) begin operation. At this time, the light emitted from the light emitting element (R) of the detection sensor (S1) is received by the two light receiving elements (R1, R2), and the light emitted from the light emitting element (L) of the detection sensor (S2) is received by the two light receiving elements (L1, L2), allowing the two detection sensors (S1, S2) to detect both the criss-crossing triangular detection areas (A, B)

Then the user putts a ball (G) sitting on a set position (for example the P1 position) in the putting mat (5) along the virtual central line toward the reaction panel (2) of the body (1).

(A) When the ball moved toward the center:

The putted ball advances, hits the reaction panel (2) of the body (1), and bounces back. At this time, before the ball hits the reaction panel (2), it passes the two criss-crossing triangular detection areas (A, B) on the putting mat (5). In other words, the ball passes the detection line (T1) of the detection sensor (S1) and the detection line (T3) of detection sensor (S2), and then the detection line (T2) of the detection sensor (S1) and the detection line (T4) of the detection sensor (S2).

At this time, as seen in FIG. 2, if the putted ball moves along the virtual central line (d), it passes the two points (o, o') at which the detection lines (T1, T2, T3, T4) composing the longer sides of the two triangular detection areas (A, B) cross.

At this time, each of the light receiving elements (L1, L2, R1, R2) of the detection sensors (S1, S2) on both sides left and right detects the time at which the ball passes the two beam-crossing points (o, o') and produces the data value thus obtained.

As the two identical triangles criss-cross each other symmetrically, the distances of the emitted light that meet at the two beam-crossing points are identical. Therefore, the data values (f1, f2) detected by the two detection sensors (S1, S2) are theoretically identical, and the speed and distance of the ball computed from the two sets of data values should show identically. However, taking a possible error rate into account, the two sets of data values ought to be averaged to arrive at more accurate putting distance. The results of the computation are output to be shown on the word display window (3*w*), electrooptically on the electrooptic display device (3*a*), and acoustically on the speaker (sp).

If the data values (f1, f2) detected by the detection sensors (S1, S2) are compared and turn out to be identical as f1=f2 or as f1−f2=0 or f2−f1=0, the ball has passed along the virtual central line without deviating toward either side. As stated above, as the distances between the two points where the emitted light of the two identical triangles cross are identical, the speeds of the ball passing these crossing points detected by both detection sensors (S1, S2) are identical theoretically, thereby proving that the ball has passed the central line of the triangular detection areas (A, B). Therefore, the putted ball must have hit the center of the reaction panel (2). Hence, the distance value and movement direction of the putted ball are displayed on the corresponding position in the central line on the radiating electrooptic display device (3*a*) in the display portion (3), showing the results of putting instantly.

(B) When the ball deviated toward the left:

If the putted ball deviated toward the left side line (d1) by a certain angle (−a) as shown in FIG. 2, the ball passes the crossing points (h, m, n, k) of the detection lines (T1, T2) of the detection area (A) and the detection lines (T3, T4) of the detection area (B).

At this time, the detection sensor (S1) on the left side detects, by means of the light receiving elements (R1, R2), the speed of the ball that has passed the crossing points (h, k) of the detection lines (T1, T2) of the triangular detection area (A). In the meantime, the detection sensor (S2) on the right side detects, by means of the light receiving elements (L1, L2), the speed of the ball that has passed the crossing points (m, n) of the detection lines (T3, T4) of the triangular detection area (B). At this time, the distance between the crossing points (h, k) of the triangular detection area (A) and the distance between the crossing points (m, n) of the triangular detection area (B) at which the putted ball has passed are different, and the two detection sensors (S1, S2) get two different data values (f1, f2) detected from the two different detection areas (A, B). From these two different data values, two different results may be obtained on the speed of the putted ball through computation. But, in consideration of the possible error rate during detection operation, the two computed data values (f1, f2) are added and averaged to arrive at and display more accurate putted distance.

Further, if the data value (f1) detected by the detection sensor (S1) and the data value (f2) detected by the detection sensor (S2) are compared and turn out as f1>f2, the display shows, through triangular geometry, that the ball deviated, toward the left. The farther the ball deviates toward the left, the father the distance becomes between the detection lines (or emitted light) (T1, T2) in the detection area (A) and the shorter the distance becomes between the detection lines (or emitted light) (T3, T4) in the detection area (B). The bigger the difference between the two data values f1−f2, the ball has deviated father toward the left with wider angle (−a); the smaller the difference, the ball came closer to the virtual central line. As the data value thus detected contain triangular geometric elements, comparison and computation of only two detected data values (f1, f2) can produce and show many various detailed data on the movement directions of the putted ball. The result of the ball that has deviated toward the left of the central line is displayed on the left line on the radiating electrooptic display device (3*a*) on the display portion (3), showing the degree of deviation.

(C) When the ball deviated toward the right:

If the putted ball deviated toward the right side line (d2) by a certain angle (+a) as shown in FIG. 2, the ball passes the crossing points (m', h', k', n') of the detection lines (T3, T4) of the triangular detection area (B) and the detection lines (T1, T2) of the triangular detection area (A).

The computation of the putted distance of the ball via speed has been explained twice already, therefore, the explanation on this will not be repeated here, but explanation will be given on the detection of the movement direction when the ball deviated toward the right.

The detection sensor (S1) on the left side detects, by means of the light receiving elements (R1, R2), the speed of the ball that has passed the crossing points (h', k') of the detection lines (T1, T2) of the triangular detection area (A), arriving at a data value (f1). On the other hand, the detection sensor (S2) on the right side detects, by means of the light receiving elements (L1, L2), the speed of the ball that has passed the crossing points (m', n') of the detection lines (T3, T4) of the triangular detection area (B), arriving at a data value (f2). Of course, these data values are arrived at by computing the detected speed of the ball that has passed the areas of different distances.

If the data value (f1) detected by the detection sensor (S1) and the data value (f2) detected by the detection sensor (S2) are compared and turn out as f1<f2, showing that f2 is larger than f1, the ball has deviated toward the right. The farther the ball deviates toward the right, the shorter the distance becomes between the detection lines (or emitted light) (T1, T2) in the detection area (A) and the farther the distance becomes between the detection lines (or emitted light) (T3, T4) in the detection area (B). Because of the triangular geometric feature, the bigger the difference between the two data values f1−f2, the ball has deviated father toward the right with wider angle (+a); the smaller the difference, the ball came closer to the virtual central line. The result of the ball that has deviated toward the right of the central line is displayed on the right line on the radiating electrooptic display device (3*a*) on the display portion (3), showing the degree of deviation.

According to the present invention, in the situation where the putted ball has passed the two symmetrically crisscrossing triangular detection areas, two detection sensors detect and produce two sets of data values containing triangular geometric elements, then the computer compares and computes the data values to arrive at various putted distances and movement directions for the user to grasp detailed and precise result of putting by means of simple and minimal detection sensors.

In the present invention, because the light emitting elements and the light receiving elements of the sensors are fixed on the side panels on the left and right of the body, the detection conditions of the detection sensors are maintained steadily, enhancing the reliability of the detected data values, not to mention the simplicity and convenience in using the apparatus.

With its simple and convenient structure of the detection means, the apparatus not only makes it convenient to use the apparatus but reduces the production cost. Furthermore, the apparatus is effective in improving the putting skill by the display of the putted results precisely and in detail.

Besides, the data display may be reset by pressing the reset switch (s"), the putting distance may be preset at the word display window (3*b*) and the ball may be putted by placing the ball on a corresponding position (p) on the putting mat (5). The apparatus may be used for various putting games as well.

THE EFFECTS OF THE INVENTION

The putting training apparatus in the present invention is provided with two symmetrically criss-crossing triangular detection areas left and right in a plane space between side panels provided at both end sides of the body. Each of the side panels is provided with a detection sensor having a light emitting element and two light receiving elements. When a putted ball passes the triangular detection areas, two sets of data values that contain triangular geometric elements are made available. By doing so, with the simple, minimal detection device, the distances and various movement directions of the putted ball are detected in a composite manner.

Besides, the two detection sensors are fixed in the side panels on the left and right of the body, the detection conditions of the detection sensors are maintained steadily, greatly enhancing the reliability of the detected data values and making the use of the apparatus easy and convenient.

Furthermore, despite the fact that the detected data from the two detection sensors are the data on the moving speed of the putted ball, the two sets of detected data contain triangular geometric elements. Therefore, through the computation by the computer, various data of the putted ball are made available from the passage of the ball in the plane space where the triangles criss-cross.

Furthermore, as the structure of the detecting means is very simple with improved composite functions, the distances and the movement directions of the putted ball are easily grasped for efficient putting training.

What is claimed is:

1. A golf putting apparatus, comprising:

a first detection sensor for use in detecting the movement of a golf ball, wherein said first detection sensor has a first light emitting element and an initially traversed light receiving element and a subsequently traversed light receiving element that make up a pair of first light receiving elements that face said first light emitting element and receive light emitted from said first light emitting element, wherein said first detection sensor is arranged such that a putted golf ball moves first past said initially traversed light receiving element and then subsequently moves past said first light emitting element and then subsequently moves past said subsequently traversed light receiving element;

a second detection sensor for use in detecting the movement of a golf ball, wherein said second detection sensor has a second light emitting element and a pair of second light receiving elements that face said second light emitting element and receive light emitted from said second light emitting element, wherein said first light emitting element is located between said pair of second light receiving elements; and a computer configured to receive at least one signal from said first and second detection sensors in order to determine at least one movement characteristic of a putted golf ball.

2. The golf putting apparatus as set forth in claim 1, wherein said pair of first light receiving elements of said first detection sensor are not activated by light emitted from said second light emitting element of said second detection sensor, and wherein said pair of second light receiving elements of said second detection sensor are not activated by light emitted from said first light emitting element of said first detection sensor.

3. The golf putting apparatus as set forth in claim 1, wherein movement of a golf ball past said first detection sensor and said second detection sensor results in disruption of light to four of said light receiving elements.

4. The golf putting apparatus as set forth in claim 1, further comprising a display portion in communication with said computer and configured for displaying to the user at least one movement characteristic of a putted golf ball.

5. The golf putting apparatus as set forth in claim 1, wherein the movement characteristic determined by said computer is selected from the group consisting of the distance of a pufted golf ball, the speed of a putted golf ball, and the angular orientation of a putted golf ball.

6. A golf putting apparatus, comprising:

a first detection sensor for use in detecting the movement of a golf ball, wherein said first detection sensor has a first light emitting element and a pair of first light receiving elements that face said first light emitting element and receive light emitted from said first light emitting element;

a second detection sensor for use in detecting the movement of a golf ball, wherein said second detection sensor has a second light emitting element and a pair of second light receiving elements that face said second light emitting element and receive light emitted from said second light emitting element; and a computer configured to receive at least one signal from said first and second detection sensors in order to determine at least one movement characteristic of a putted golf ball;

wherein said second light emitting element of said second detection sensor is located halfway between said pair of first light receiving elements of said first detection sensor, and wherein said first light emitting element of said first detection sensor is located halfway between said pair of second light receiving elements of said second detection sensor.

7. A golf putting apparatus, comprising:

a first detection sensor for use in detecting the movement of a golf ball, wherein said first detection sensor has a first light emitting element and a pair of first light receiving elements that face said first light emitting element and receive light emitted from said first light emitting element;

a second detection sensor for use in detecting the movement of a golf ball, wherein said second detection sensor has a second light emitting element and a pair of second light receiving elements that face said second light emitting element and receive light emitted from said second light emitting element; and a computer configured to receive at least one signal from said first and second detection sensors in order to determine at least one movement characteristic of a putted golf ball;

wherein said first detection sensor is in the shape of a triangle such that said first light emitting element is located at a vertex position and said pair of first light receiving elements are located at corner positions and wherein the distances from said first light emitting element to each of said pair of first light receiving elements are equal in length and form the longer sides of the triangle and wherein the distance between said first light receiving elements is shorter than the distances from said first light emitting element to each of said pair of first light receiving elements and forms the shorter side of the triangle, and wherein said second detection sensor is in the shape of a triangle such that said second light emitting element is located at a vertex position and said pair of second light receiving elements are located at corner positions and wherein the distances from said second light emitting element to each of said pair of second light receiving elements are equal in length and form the longer sides of the triangle and wherein the distance between said second light receiving elements is shorter than the distances from said second light emitting element to each of said pair of second light receiving elements and forms the shorter side of the triangle.

8. The golf putting apparatus as set forth in claim 7, wherein said first detection sensor and said second detection sensor are arranged symmetrically with respect to one another such that the vertex position of said first detection sensor is located halfway between the corner positions of said second detection sensor and such that the vertex position of said second detection sensor is located halfway between the corner positions of said first detection sensor.

9. A golf putting apparatus, comprising:

a first detection sensor for use in detecting the movement of a golf ball, wherein said first detection sensor has a first light emitting element and a pair of first light receiving elements that face said first light emitting element and receive light emitted from said first light emitting element;

a second detection sensor for use in detecting the movement of a golf ball, wherein said second detection sensor has a second light emitting element and a pair of second light receiving elements that face said second light emitting element and receive light emitted from said second light emitting element;

a computer configured to receive at least one signal from said first and second detection sensors in order to determine at least one movement characteristic of a putted golf ball;

a reaction panel configured for being struck by a putted golf ball;

a putting mat onto which a golf ball is putted to said reaction panel;

a left side panel that carries said pair of first light receiving elements of said first detection sensor and said second light emitting element of said second detection sensor; and a right side panel that carries said pair of second light receiving elements of said second detection sensor and said first light emitting element of said first detection sensor;

wherein at least a portion of said putting mat is located between said left side panel and said right side panel such that a putted golf ball passes between said left side panel and said right side panel before striking said reaction panel.

10. A golf putting apparatus, comprising:

a first light emitting element capable of emitting light that is located in at least a first location and a second location with respect to one another so as to form an acute angle; and a second light emitting element capable of emitting light that is located in at least a third location and a fourth location with respect to one another so as to form an acute angle, wherein said second light emitting element is located between two of the vertices of the acute angle formed by the emitted light of said first light emitting element;

wherein light from said first location of said first light emitting element is arranged to intersect light from said third location of said second light emitting element to form a first intersection point, and wherein light from said second location of said first light emitting element is arranged to intersect light from said fourth location of said second light emitting element to form a second intersection point, wherein said first intersection point and said second intersection point lie along a centerline putted golf ball path.

11. The golf putting apparatus as set forth in claim 10, wherein light emitted from said first and second light emitting elements are oriented in the same plane.

12. The golf putting apparatus as set forth in claim 10, further comprising:

a computer configured to receive signals corresponding to the interruption of emitted light in order to determine at least one movement characteristic of a putted golf ball; and a display portion in communication with said computer and configured for displaying to the user the at least one movement characteristic.

13. The golf putting apparatus as set forth in claim 12, wherein the movement characteristic determined by said computer and displayed by said display portion is selected from the group consisting of the distance of a putted golf ball, the speed of a putted golf ball, and the angular orientation of a putted golf ball with respect to the centerline putted golf ball path.

14. The golf putting apparatus as set forth in claim 12, wherein said first light emitting element directly faces said second light emitting element.

15. The golf putting apparatus as set forth in claim 10, wherein a golf ball putted at an angle to the centerline putted golf ball path to the right side of the centerline putted golf ball path first interrupts emitted light from said third location of said second light emitting element and subsequently interrupts emitted light from said first and second locations of said first light emitting element and then subsequently interrupts emitted light from said fourth location of said second light emitting element.

16. The golf putting apparatus as set forth in claim 10, wherein a golf ball putted at an angle to the centerline putted golf ball path to the left side of the centerline putted golf ball path first interrupts emitted light from said first location of said first light emitting element and subsequently interrupts emitted light from said third and said fourth locations of said second light emitting element and then subsequently interrupts emitted light from said fourth second location of said first light emitting element.

17. A golf putting apparatus, comprising:

a first light emitting element capable of emitting light that is located in at least a first location and a second location with respect to one another so as to form an acute angle;

a second light emitting element capable of emitting light that is located in at least a third location and a fourth location with respect to one another so as to form an acute angle;

wherein light from said first location of said first light emitting element is arranged to intersect light from said third location of said second light emitting element to form a first intersection point, and wherein light from said second location of said first light emitting element is arranged to intersect light from said fourth location of said second light emitting element to form a second intersection point, wherein said first intersection point and said second intersection point lie along a centerline putted golf ball path;

a pair of first light receiving elements that receive light emitted by said first light emitting element, wherein said second light emitting element is located halfway between said pair of first light receiving elements; and a pair of second light receiving elements that receive light emitted by said second light emitting element, wherein said first light emitting element is located halfway between said pair of second light receiving elements.

18. The golf putting apparatus as set forth in claim 1, wherein said pair of first light receiving elements do not receive light emitted from said second light emitting element, and wherein said pair of second light receiving elements do not receive light emitted from said first light emitting element.

19. A golf putting apparatus, comprising:

a first light emitting element capable of emitting light that is located in at least a first location and a second location with respect to one another so as to form an acute angle;

a second light emitting element capable of emitting light that is located in at least a third location and a fourth location with respect to one another so as to form an acute angle;

wherein light from said first location of said first light emitting element is arranged to intersect light from said third location of said second light emitting element to form a first intersection point, and wherein light from said second location of said first light emitting element is arranged to intersect light from said fourth location of said second light emitting element to form a second intersection point, wherein said first intersection point and said second intersection point lie alone a centerline putted golf ball path;

a reaction panel configured for being struck by a putted golf ball, wherein said reaction panel is declined;

a putting mat onto which a golf ball is putted to said reaction panel;

a left side panel that carries said second light emitting element; and a right side panel that carries said first light emitting element;

wherein at least a portion of said putting mat is located between said left side panel and said right side panel such that a putted golf ball passes between said left side panel and said right side panel before striking said reaction panel.

20. A golf putting apparatus, comprising:

a first detection sensor for use in detecting the movement of a golf ball, wherein said first detection sensor has a first light emitting element and a pair of first light receiving elements that receive light emitted from said first light emitting element, wherein said first detection sensor is in the shape of a triangle such that said first light emitting element is located at a vertex position and said pair of first light receiving elements are located at corner positions and wherein the distances from said first light emitting element to each of said pair of first light receiving elements are equal in length and form the longer sides of the triangle and wherein the distance between said first light receiving elements is shorter than the distances from said first light emitting element to each of said pair of first light receiving elements and forms the shorter side of the triangle;

a second detection sensor for use in detecting the movement of a golf ball, wherein said second detection sensor has a second light emitting element and a pair of second light receiving elements that receive light emitted from said second light emitting element, wherein said second detection sensor is in the shape of a triangle such that said second light emitting element is located at a vertex position and said pair of second light receiving elements are located at corner positions and wherein the distances from said second light emitting element to each of said pair of second light receiving elements are equal in length and form the longer sides of the triangle and wherein the distance between said second light receiving elements is shorter than the distances from said second light emitting element to each of said pair of second light receiving elements and forms the shorter side of the triangle;

a reaction panel configured for being struck by a putted golf ball;

a putting mat onto which a golf ball is putted to said reaction panel;

a left side panel that carries said pair of first light receiving elements of said first detection sensor and said second light emitting element of said second detection sensor, wherein said second light emitting element of said second detection sensor is located halfway between said pair of first light receiving elements of said first detection sensor;

a right side panel that carries said pair of second light receiving elements of said second detection sensor and said first light emitting element of said first detection sensor, wherein said first light emitting element of said first detection sensor is located halfway between said pair of second light receiving elements of said second detection sensor;

wherein at least a portion of said putting mat is located between said left side panel and said right side panel such that a putted golf ball passes between said left side panel and said right side panel before striking said reaction panel;

a computer configured to receive at least one signal from said first and second detection sensors in order to determine the speed of a putted golf ball and the angular orientation of the putted golf ball to a centerline putted golf ball path; and a display portion in communication with said computer and configured for displaying the speed of the putted golf ball and the angular orientation of the putted golf ball to the centerline putted golf ball path.

* * * * *